US007615249B1

(12) United States Patent
Kudwa

(10) Patent No.: US 7,615,249 B1
(45) Date of Patent: Nov. 10, 2009

(54) METHOD FOR PREPARING ARROW SHAFTS WITH LUBRICANT COATINGS

(76) Inventor: Douglas G. Kudwa, 8300 Fish Lake Rd., Holly, MI (US) 48442

( * ) Notice: Subject to any disclaimer, the term of this patent is extended or adjusted under 35 U.S.C. 154(b) by 0 days.

(21) Appl. No.: 12/136,840

(22) Filed: Jun. 11, 2008

Related U.S. Application Data

(60) Provisional application No. 60/943,728, filed on Jun. 13, 2007.

(51) Int. Cl.
*B05D 1/12* (2006.01)

(52) U.S. Cl. ..... 427/201; 427/385.5

(58) Field of Classification Search ..... 427/201
See application file for complete search history.

(56) References Cited

U.S. PATENT DOCUMENTS 7,387,578 B2 * 6/2008 Palumbo et al. ..... 473/320
2006/0160636 A1 * 7/2006 Palumbo et al. ..... 473/316

* cited by examiner

*Primary Examiner*—Frederick J Parker
(74) *Attorney, Agent, or Firm*—Steve M. Clemmons

(57) ABSTRACT

A method for reducing the coefficient of friction of an archery arrow's shaft to ease the retrieval of the arrow from an archery target. The method includes covering the shaft between the ferrule and fletching with a PTFE-based lubricating material, buffing the lubricant to a uniform thickness along the arrow shaft and heating the lubricated shaft to set the PTFE to the arrow shaft.

11 Claims, 1 Drawing Sheet

METHOD FOR PREPARING ARROW SHAFTS WITH LUBRICANT COATINGS

CROSS-REFERENCE TO RELATED APPLICATION

This application claims priority of United States Provisional Patent Application filed Jun. 13, 2007 having Ser. No. 60/943,728.

FIELD OF THE INVENTION

The present invention relates to archery and, more particularly, to a method for coating arrow shafts to ease retrieval of arrows from archery targets.

BACKGROUND AND SUMMARY OF THE INVENTION

Currently, archers have difficulty in extracting their arrows from a target. This is particularly so when dense closed-cell targets are used. These targets receive and expand around the arrow shaft and due to the high degree of friction of the cellular material along with the high penetration depths achieved by modern bows, pulling an arrow from such a target can be extremely difficult.

Retrieving such a stuck arrow therefore requires the user to use a relatively large amount of force to pull these "stuck" arrows from a target. If care is not taken retrieving these arrows, however, the user can possibly either injure himself or damage either the arrow or the target. It should be appreciated that even the slightest bend or curve made into an arrow shaft can cause great in-flight inaccuracy.

The broad purpose of the present invention is to provide a safe and easy process for reducing the coefficient of friction of the outer surface of an arrow shaft.

Prior art attempts to reduce the friction between the arrow and target involve the repeated application of a silicone-containing liquid to the arrowhead and the front portion of the arrow shaft. One example of such a prior art method is disclosed in U.S. Pat. No. 6,093,685 issued to Gary L. Wood, Sr. on Jul. 25, 2000. This patent discloses a liquid-based silicone lubricant that is applied with either a dauber or by dipping an arrow into a lubricant containing vessel. This method of lubricating an arrow, however, suffers from the drawback of having to repeatedly reapply the lubricant while shooting. Additionally, after reapplying the liquid, the archer must then wait for the liquid to dry prior to shooting.

The present invention overcomes the above-referenced and other disadvantages of prior art techniques for easing the retrieval of arrows from a target by semi-permanently applying a lubricant material upon the outer surface of the arrow's shaft. This lubricant material includes a solid particulate material having a very low coefficient of friction which is suspended in a semi-fluid paste or wax. By buffing and/or heating the lubricant material, the user can ensure the non-stick material is fixed to the shaft.

The present invention provides a novel method of lubricating an arrow that conditions the arrow's shaft using a polytetrafluoroetylene (PTFE) based solid lubricant, such as the materials sold under the trademarks Teflon and Zonyl by the E. I. Du Pont De Nemours and Co., Corporation. This lubricant is applied suspended within a thin layer of paste, wax or colloid (e.g., a sol gel) onto an arrow shaft. In the preferred embodiment, heat is applied to the lubricant-coated arrow to aid in drying and speeding the set-up of the lubricant to the shaft. In one embodiment the lubricant is rubbed or buffed onto the arrow shaft.

It is an advantage of the present invention to provide a method for easily retrieving arrows from an archery target, the method including the steps of providing a PTFE-based lubricant, applying the lubricant to an arrow shaft, and heating the lubricant to set the lubricant upon the shaft.

It is another advantage of the present invention that the PTFE in the lubricant can be sintered to the outer surface of an arrow shaft by heating the coated arrow shaft.

It is still another advantage of the present invention that a PTFE-based lubricant is applied to the arrow shaft to ensure that the lubricating material is both non-reactive and that the high-temperatures of the arrow head and shaft entering a target do not melt or degrades the lubricant.

It is yet another advantage of the present invention that an arrow shaft having microscopic cracks and fissures in its outer surface that is lubricated according to the present invention, will have the cracks and fissures filled and smoothed by the lubricant.

It is still yet another advantage of the present invention that the lubricated arrow shaft reduces friction losses and noise as the arrow slides along the arrow rest.

It is still yet another advantage of the present invention that the lubricated arrow shaft reduces in-flight drag of the arrow.

Still further objects and advantages of the invention will become readily apparent to those skilled in the art to which the invention pertains upon reference to the following detailed description.

BRIEF DESCRIPTION OF THE DRAWINGS

The description refers to the accompanying drawings in which like reference characters refer to like parts throughout the several views; and in which.

DETAILED DESCRIPTION OF THE INVENTION

Figure 1:
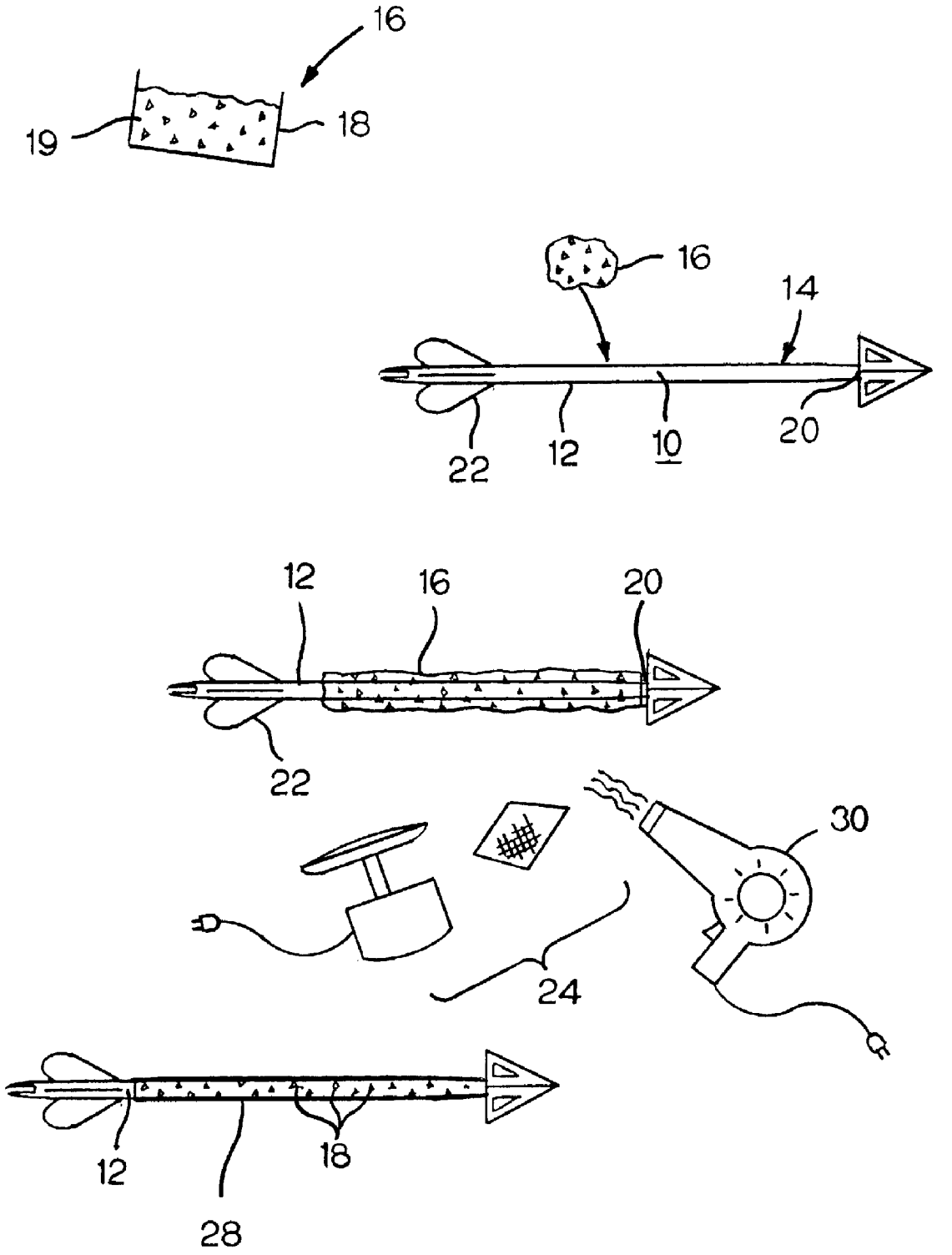
FIG. 1 is a graphical representation of the method steps used to lubricate an arrow shaft.

Referring now to FIG. 1, a preferred method of lubricating the outer surface 10 of the shaft 12 of an archery arrow 14 is shown. As will be discussed further below, a lubricant material 16 is applied to arrow shaft 12, which is then heated to set or fix the material 16 upon the shaft 12. Arrow shaft 12 can be substantially any conventional archery arrow shaft, including aluminum, graphite, carbon fiber, or wood.

Lubricant material 16 is preferably a wax, paste or colloidal sol which suspends and contains microscopic, 2-20 μm, particles of lubricating solids 18, such as polytetrafluoroethylene (PTFE). The binder material 19 (e.g., wax) is preferably a low-cost shelf stable material which readily accepts the lubricating solid particles 18. In the preferred embodiment, the lubricating solid 18 comprises 0.5-5% of the lubricant material 16 by weight.

While PTFE is preferred due to its very low coefficient of friction and non-reactivity, it should be appreciated that other lubricating solids can be used in material 16. PTFE is also preferable due to the high melting temperature of approximately 620° F. This high melting point allows for a relatively high operating temperature range such that any heat encountered by the arrow 14 will not affect the lubricating properties of material 16.

One example of how a lubricant having a high operating temperature has advantages over other lubricants like silicone is that metal arrowheads and broadheads generate a great deal of friction as they enter conventional archery targets, particularly closed-cell foam archery targets. This friction quickly generates heat which passes through the broadhead, into the ferrule, and down the arrow shaft. This is particularly so, if the arrow shaft is made of a conductive material like aluminum. This heat may breakdown, degrade, or otherwise melt other lubricant materials, which would prevent the lubricant from performing its intended purpose of easing the retrieval of the arrow from the target. Further, this thermal breakdown of the lubricant will necessitate reapplication of the lubricant to the arrow.

In one embodiment of the invention, binder material 19 and particulates 18 are first wiped onto arrow shaft 12. The lubricant 16 is preferably applied along the outer surface 12 of the arrow shaft 12 between the ferrule 20 (i.e., the front of the shaft having means for attaching the arrowhead) and the fletching 22. Then buffing means 24, such as a mechanical buffing wheel or a simple cloth, is used to repeatedly pass over the outer surface 10 of the arrow shaft 12. This buffing operation ensures that the lubricant material 16 is applied as a relatively thin uniform layer 28 which is thoroughly applied to shaft 12 and also fills any microscopic cracks, pits, or fissures in the shaft 12 with the material 16.

This buffing process typically generates heat, which in addition to the physical removal or wiping away of excess material 16 causes binder 19 to at least partially melt/evaporate to leave a thin layer 28 of material 16 upon surface 10. This thin layer 28, while still retaining the low-friction particulates 18 and exhibiting the low coefficient of friction of these particulates, does not greatly increase the weight of arrow 14 or cause imbalance issues for arrow 14.

In another non-limiting embodiment, the lubricating particles 18 are sintered to the arrow shaft 12. This process of sintering the lubricating solid to outer surface 14 is preferably achieved by heating the particles 18 to just below their melting temperature, such that the particles bond together in an around the arrow. For a PTFE-based lubricant 16, this temperature may be approximately 600° F. In one non-limiting embodiment, such a process may be accomplished with a conventional heat gun 30 or through a conventional oven-based heat treating process. In this embodiment, the wax or paste binder 19 retaining the solid particles 18 will melt away and leave the now-sintered non-stick material 18 upon the shaft 12.

From the foregoing description, one skilled in the art will readily recognize that the present invention is directed to a method for conditioning an arrow shaft to ease removal of the arrow from an archery target. While the present invention has been described with particular reference to various preferred embodiments, one skilled in the art will recognize from the foregoing discussion and accompanying drawings that changes, modifications and variations can be made in the present invention without departing from the spirit and scope thereof.

The invention claimed is:

1. A method for preparing the outer surface of an archery arrow's shaft to easily retrieve the arrow from an archery target, the method including the steps of:

providing a lubricant containing PTFE by adding solid PTFE particles to a wax binder;

applying the lubricant to the arrow shaft; and heating the lubricant applied to the arrow shaft to set the lubricant upon the shaft.

2. A method as defined in claim 1, wherein said step of heating the lubricant further comprises sintering the PTFE to the arrow shaft.

3. A method as defined in claim 1, wherein said step of applying the lubricant further comprises the steps of:

filling any cracks and fissures upon the outer surface of the arrow shaft with the lubricant; and smoothing the lubricant applied to the shaft to a uniform thickness along the arrow shaft.

4. A method as defined in claim 1, further comprising buffing the lubricant applied to the arrow shaft prior to heating the lubricant.

5. A method as defined in claim 1, wherein the arrow includes rearwardly mounted fletching, wherein said step of applying the lubricant comprises covering the entire outer surface with said lubricant between a front end of said arrow shaft and the fletching.

6. A method for reducing the coefficient of friction of the outer-most surface of an archery arrow's shaft to easily retrieve the arrow from an archery target, the method including the steps of:

applying a layer of lubricant containing solid PTFE particles retained within a wax binder along an arrow shaft between the ferrule and fletching; and buffing the lubricant applied to the arrow shaft, whereby said layer of lubricant has a substantially uniform thickness along said arrow shaft.

7. A method as defined in claim 6, further comprising the step of:

heating the lubricant applied to the arrow shaft to sinter the PTFE particles onto the shaft.

8. A method as defined in claim 7, wherein said step of heating the lubricant comprises raising the temperature of the layer of lubricant until the PTFE particles in the lubricant adhere to each other around the arrow shaft.

9. A method as defined in claim 6, further comprising the step of:

filling any cracks in an outer surface of the arrow shaft with the lubricant.

10. A method of permanently lubricating an outer surface of an archery arrow's shaft, comprising the steps of:

applying a wax containing 0.5%-5% solid PTFE by weight to the outer surface;

buffing the applied wax to a uniform thickness along the shaft; and heating the waxed arrow shaft to sinter the PTFE around the shaft.

11. A method as defined in claim 10, wherein said step of applying a wax further comprises filling any cracks in the outer surface with the wax.

* * * * *